US006599176B2

(12) United States Patent
Hoffman

(10) Patent No.: US 6,599,176 B2
(45) Date of Patent: Jul. 29, 2003

(54) HIGH SPEED CENTRIFUGAL PROCESSOR

(75) Inventor: Steve E. Hoffman, Englewood Cliffs, NJ (US)

(73) Assignee: Mikronite Technologies Group Inc., Carlstadt, NJ (US)

( * ) Notice: Subject to any disclaimer, the term of this patent is extended or adjusted under 35 U.S.C. 154(b) by 19 days.

(21) Appl. No.: 09/965,270

(22) Filed: Sep. 27, 2001

(65) Prior Publication Data

US 2003/0060148 A1 Mar. 27, 2003

(51) Int. Cl.[7] ..... B24B 31/02
(52) U.S. Cl. ..... 451/326; 451/328; 451/329
(58) Field of Search ..... 451/32, 326, 327, 451/328, 329, 269, 271

(56) References Cited

U.S. PATENT DOCUMENTS

| | | | | | |
|---|---|---|---|---|---|
| 3,233,372 | A | * | 2/1966 | Kobayashi | 451/32 |
| 3,513,604 | A | * | 5/1970 | Dreher | 451/32 |
| 4,073,095 | A | * | 2/1978 | Dreher | 451/329 |
| 4,586,292 | A | * | 5/1986 | Carroll et al. | 451/329 |
| 4,967,514 | A | * | 11/1990 | Kunz | 451/326 |
| 5,140,783 | A | | 8/1992 | Hoffman | 51/313 |
| 5,295,330 | A | | 3/1994 | Hoffman | 51/163 |
| 5,355,638 | A | | 10/1994 | Hoffman | 451/32 |
| 5,454,749 | A | * | 10/1995 | Ohno | 451/329 |
| 5,507,685 | A | | 4/1996 | Hoffman | 451/34 |
| 5,848,929 | A | | 12/1998 | Hoffman | 451/32 |

* cited by examiner

*Primary Examiner*—M. Rachuba
(74) *Attorney, Agent, or Firm*—Drinker Biddle & Reath LLP

(57) ABSTRACT

An apparatus is disclosed for performing high speed processing of a workpiece. The apparatus includes an outer vessel having an inner surface and a central axis. At least one intermediate vessel is located within the outer vessel and has an outer surface which contacts the inner surface of the outer vessel. At least one inner vessel is positioned within the intermediate vessel and adapted to receive an object to be subjected to a manufacturing process. The inner vessel is located at a position within the intermediate vessel such that the central axis of the inner vessel is spaced apart from the central axis of the outer vessel. A drive system controls the rolling of the intermediate vessel along the inner surface of the outer vessel. The rolling of the intermediate vessel causes the inner vessel to rotate about its axis and the axis of the outer vessel.

24 Claims, 4 Drawing Sheets

HIGH SPEED CENTRIFUGAL PROCESSOR

FIELD OF THE INVENTION

The present invention relates to an apparatus for providing material processing, such as finishing, of an article through high speed centrifugal and rotational motion.

BACKGROUND OF THE INVENTION

In recent years, a realization has developed regarding the importance of surface finishing in the manufacture of a product. For many products it is desirable, and in some cases mandatory, that the products be finished so as to have a smooth surface without any reduction in the material characteristics of the product that are essential for its intended purpose. Various processes have been developed over the years to provide surface finishing.

Some finishing machinery use the centrifugal force imparted by a rotating vessel to finish products. A number of these machines subject objects to both centrifugal and rotational forces using a complicated set of gears. These types of machines are limited to a particular ratio of revolutional speed to rotational speed. Also, the construction of these machines is complicated requiring many moving parts, and are generally extremely noisy. Other types of machines create centrifugal forces by revolving a vessel around a shaft and creating rotational forces using a belt wrapped around the shaft and the exterior of the vessel. The speed of the belt is related to the speed of the shaft. Overheating is common in these types of machines.

One successful machine using both centrifugal and rotational forces in a simple design without a system of gears and which can be operated at very high speeds is disclosed in U.S. Pat. No. 5,355,638 to Hoffman, the disclosure of which is hereby incorporated by reference in its entirety. As disclosed in that '638 patent, the centrifugal finisher (or polisher) has an outer vessel that is rotatable, and at least one inner vessel that is revolved about the axis of the rotatable outer vessel and rotated about its own axis. A traction surface exists between the inner surface of the outer vessel and the outer surface of the inner vessel. The traction surface allows the outer vessel to restrain the inner vessel while the inner vessel experiences centrifugal forces. This machine simultaneously causes the rotational movement of the inner vessel to transfer momentum from the outer vessel to the inner vessel because the outer vessel is rotated at a different speed and potentially a different direction than the rotational movement of the inner vessel, thus causing the revolution of the inner vessel.

The '638 patent also discloses an apparatus where a center drive can be used for rotating the outer vessel and the inner vessel. One drawback of this type of machine is its size limitation because the outer vessel must be designed to rotate. For large objects, this becomes impractical and expensive. Additionally, because of the interaction between the inner and outer vessels, it is not possible to control rotation of the inner vessel without controlling rotation of the outer vessel. Also, the operation of the whole unit is constrained by the total RPM that the unit can operate under, and particularly the speed of the outer vessel, which can be difficult to manage when greater diameters are required.

Another successful machine using both centrifugal and rotational forces and which addresses the limitations of the device in the '638 patent is disclosed in U.S. Pat. No. 5,848,929 to Hoffman, the disclosure of which is hereby incorporated by reference in its entirety. The '929 patent discloses a centrifugal finisher with a fixed outer vessel which permits much larger objects to be finished without the need to apply excessive energy and force to the unit. Additionally, the device in the '929 patent permits the inner vessel to be removed so that vessels of various diameters can be used in the unit without necessarily having to change the outer vessel.

Due to restrictions on speed, conventional centrifugal machines are limited in the types of material processing they can perform on objects, Primarily, these types of machines are limited to surface finishing of objects and, using the machines described in the '638 and '929 patents, surface hardening. The speed restrictions prohibit these machines from being used to provide mixing of unlike materials. In order to mix such materials, conventional methods include explosive combining wherein sufficient force is created by a preset explosion to cause the unlike materials to combine.

While both the '929 patent and the '638 patent describe apparatus that provide high speed centrifugal and rotational finishing, the ultimate speed of the finishing devices is limited. A need, therefore, exists for an improved high speed centrifugal finisher. Also, it would be beneficial if a centrifugal-type machine could, by means of its high speed of operation, produce intermixing of unlike materials.

SUMMARY OF THE INVENTION

The present invention relates to an apparatus for performing high speed processing of a workpiece through the use of centrifugal and rotational motion. The apparatus includes an outer vessel having an inner surface and a central axis.

At least one intermediate vessel is located within the outer vessel and has an outer surface which contacts the inner surface of the outer vessel.

At least one inner vessel is positioned within the intermediate vessel and adapted to receive an object to be subjected to a manufacturing process. The inner vessel is located at a position within the intermediate vessel such that the central axis of the inner vessel is spaced apart from the central axis of the outer vessel.

A drive system is engaged with the intermediate vessel to control the rolling of the intermediate vessel along the inner surface of the outer vessel. The rolling of the intermediate vessel causes the inner vessel to rotate about its axis and the axis of the outer vessel.

The present invention is designed to produce significant centrifugal and rotary loads on the object contained within the inner vessel, providing a novel system for processing materials.

The foregoing and other features and advantages of the present invention will become more apparent in light of the following detailed description of the preferred embodiments thereof, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DETAILED DESCRIPTION OF THE PREFERRED EMBODIMENTS

Figure 1:
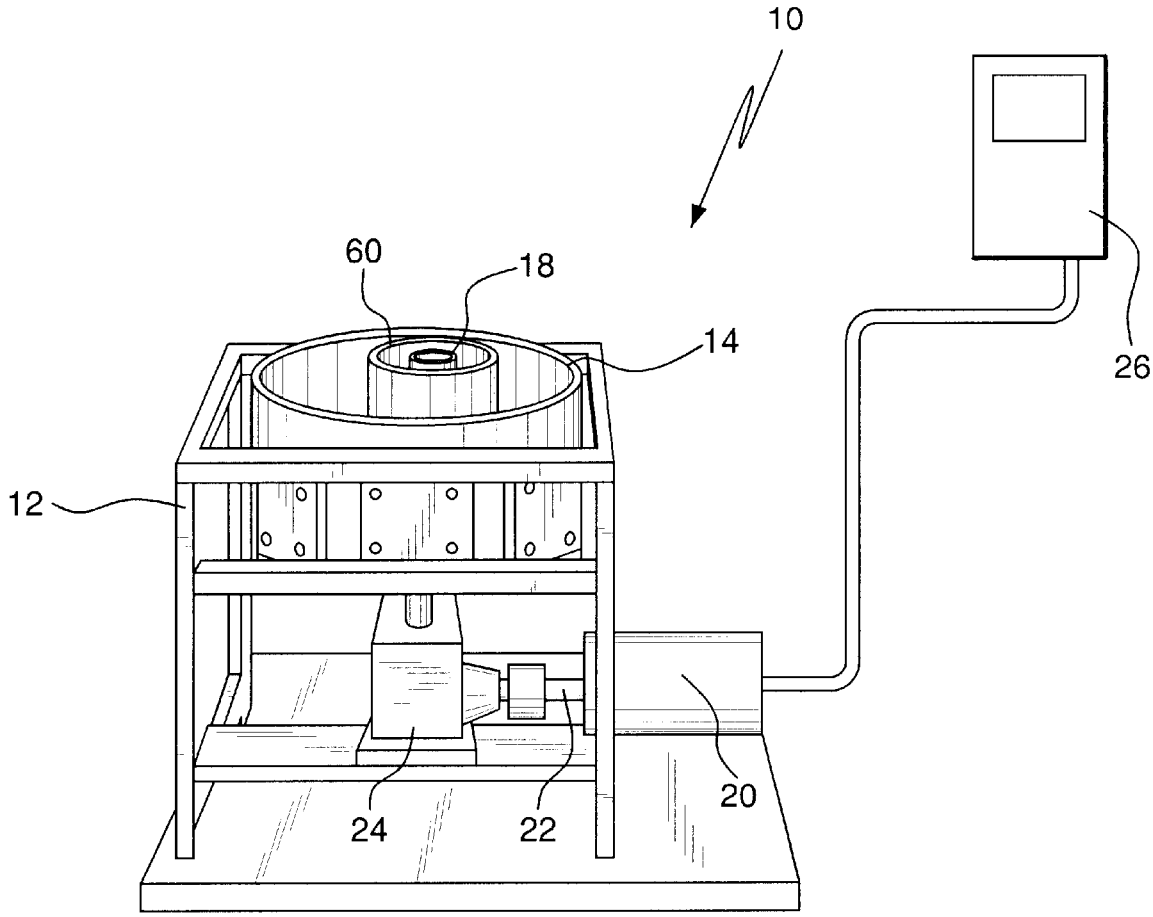
FIG. 1 is a perspective view showing the centrifugal processor according to the present invention connected to an external controller.

Referring now to the drawings, wherein like reference numerals illustrate corresponding or similar elements throughout the several views, FIG. 1 is a perspective view of one embodiment of the high speed centrifugal finisher 10 according to the present invention. The finisher 10 includes a frame 12 which supports a fixed outer vessel 14 in any conventional manner. A intermediate vessel 16 is rotatably mounted within the outer vessel 14. An inner finishing vessel 18 is located within and preferably fixedly mounted to the center of the intermediate vessel 16 so as to rotate in conjunction with the intermediate vessel 16.

A motor 20 rotatably drives a shaft 22 which is connected to the intermediate vessel 16 through a transmission 24. Any conventional motor 20 which supplies the necessary rotation speed as discussed below can be used in the present invention. The transmission 24 and shaft 22 are, likewise, conventional. The specifics of these components was discussed in more detail in U.S. Pat. No. 5,848,929.

A controller 26, such as a signal processor, electronic or digital controller or other type of motor control, is used to control the motor's speed and direction of rotation. Controllers are well known to those skilled in the art and, therefore, no further discussion is needed.

Figure 2:
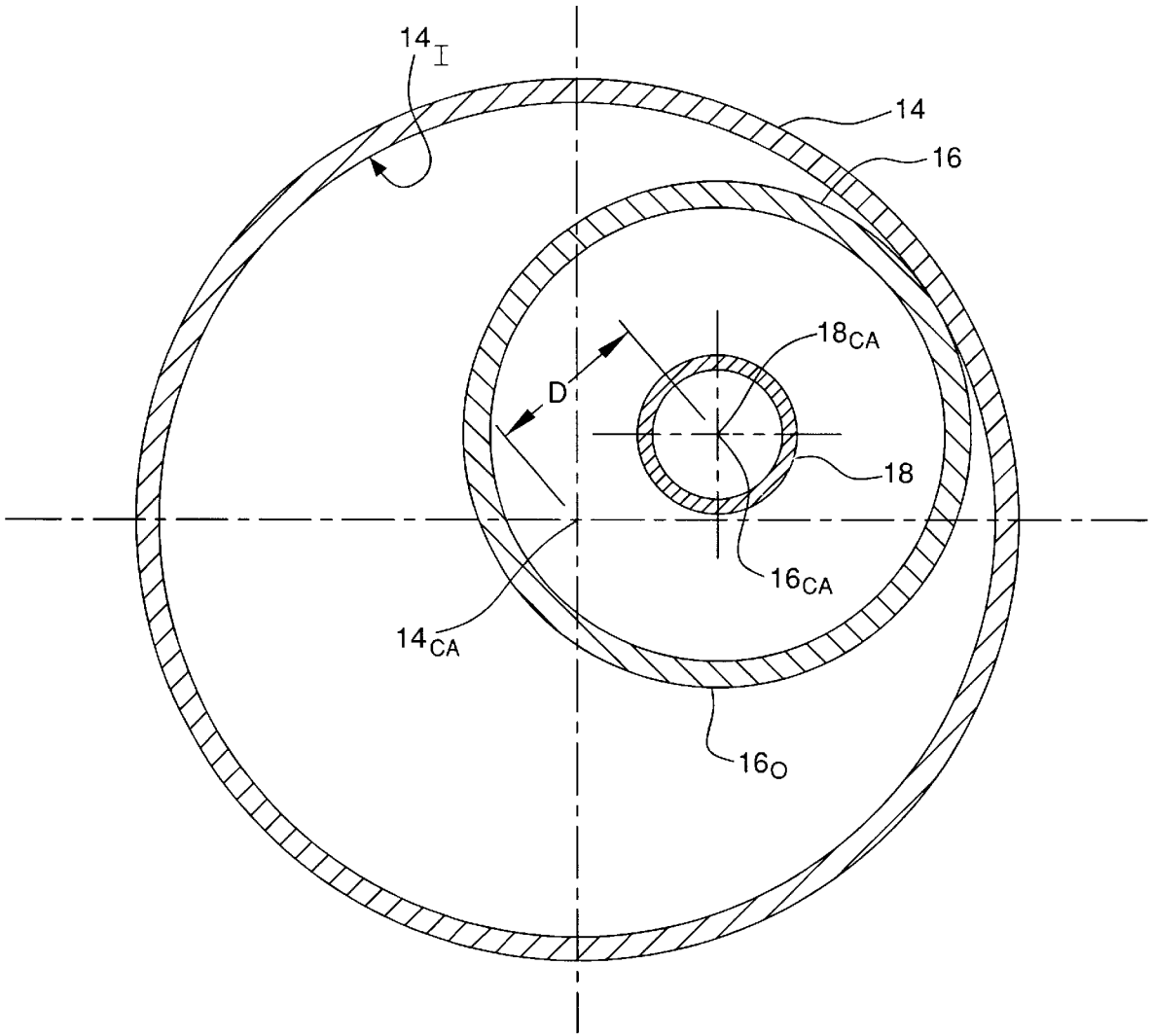
FIG. 2 is a schematic top view showing the arrangement of the vessels in the finisher.
Figure 3:
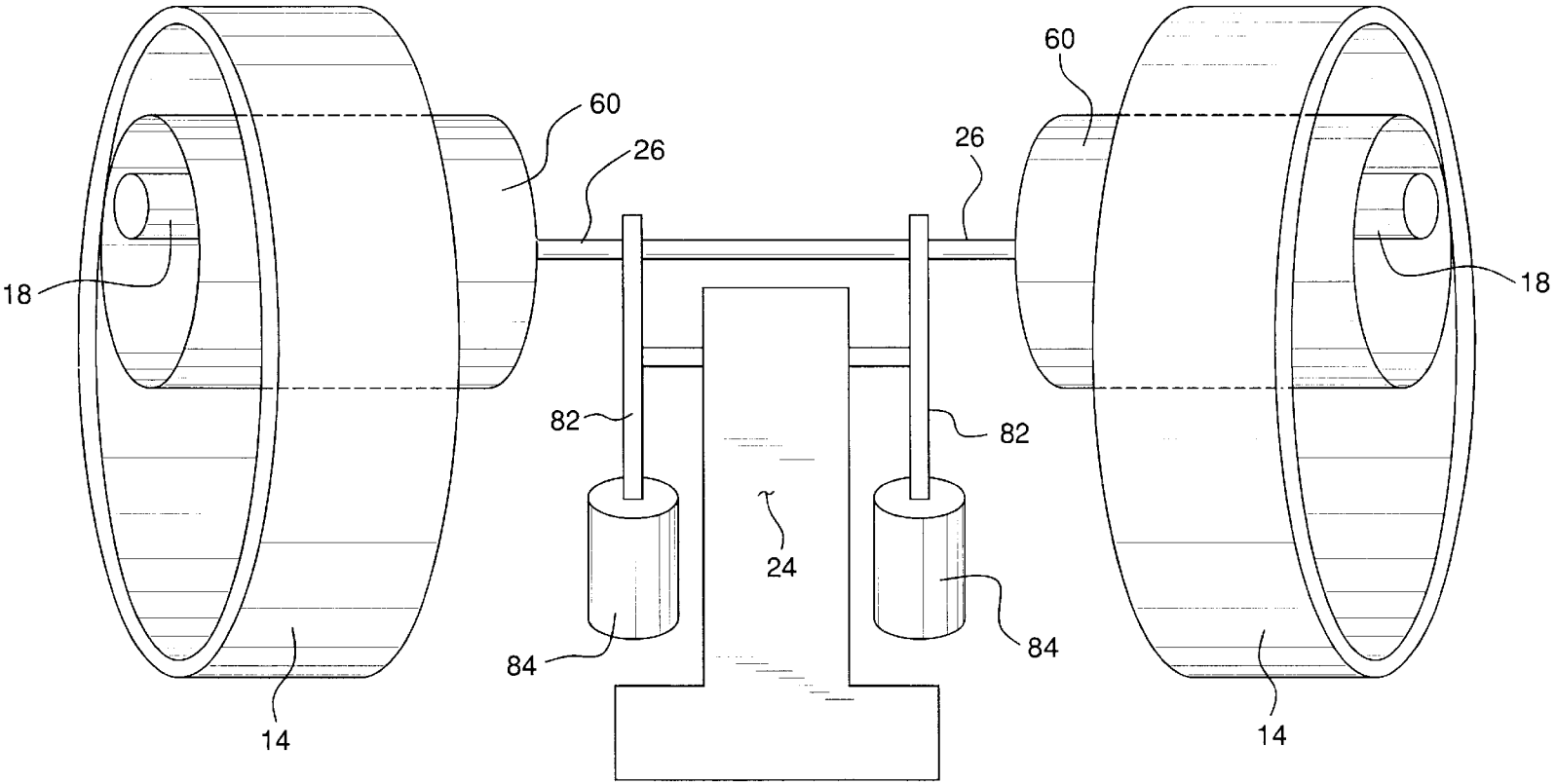
FIG. 3 is a schematic of one embodiment of the centrifugal finisher according to the present invention.
Figure 4:
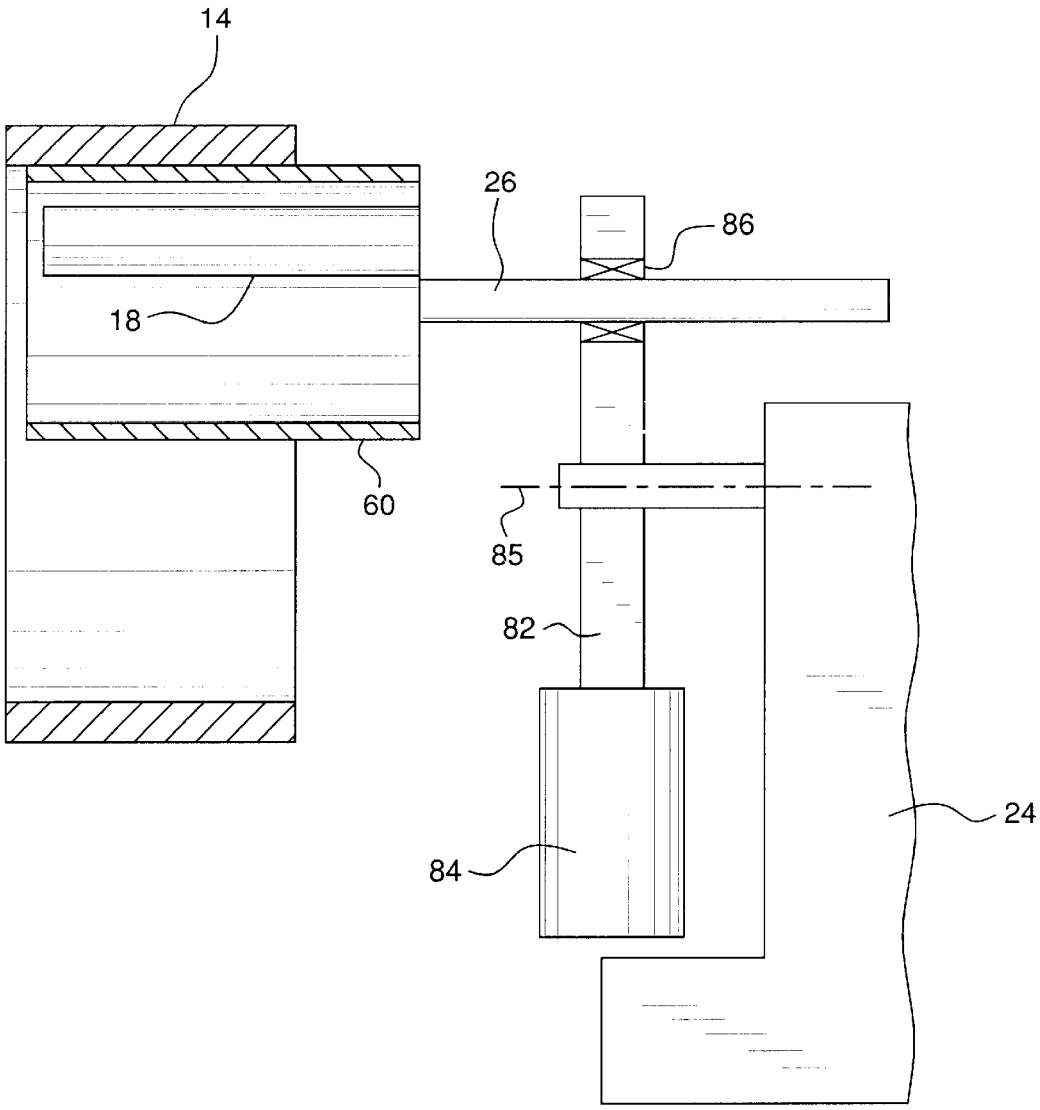
FIG. 4 is a partial cross-sectional schematic view of the embodiment of the apparatus shown in FIG. 3.

Referring now to FIG. 2, a top schematic view of the finishing vessels is shown. The specifics of the mounting of the vessels is not shown for clarity. As discussed above, the outer vessel 14 is preferably fixed to the frame 12 and, therefore, does not rotate. The outer vessel 14 is preferably made from high strength material, such as steel, to accommodate the high loads under which it will operate as discussed below.

The intermediate vessel 16 is driven by the motor 20 about an inner surface 14, of the outer vessel 14. In the illustrated embodiment the inner surface $\mathbf{14}_I$ of the outer vessel 14 is cylindrical in shape. As such, the intermediate vessel 16, which is also preferably cylindrical, is driven by the motor 20 around the inner circumference of the outer vessel 14 (i.e., rolls along the inner surface $\mathbf{14}_I$) and, thus, is rotated about the central axis $\mathbf{14}_{CA}$ of the outer vessel 14.

While one intermediate vessel 16 is shown in the illustrated embodiment, it is contemplated that more than one intermediate vessel 16 can be used. If more than one intermediate vessel 16 is used in the present invention, its diameter must be less than the radius of the outer vessel 14.

At least one inner vessel 18 is positioned inside the intermediate vessel 16 and is adapted to contain at least one object to be finished. The inner vessel 18 is preferably fixed to the intermediate vessel 16 such that the inner vessel 18 rotates in combination with the intermediate vessel 16. It is, however, also contemplated that there may be situations where it is desirable for the inner vessel 18 to rotate on its own within the intermediate vessel 16. Since in the illustrated embodiment the inner vessel 18 is fixed to the intermediate vessel 16, its shape is not critical and may be selected so as to accommodate the objects being finished within the vessel 18.

The inner vessel 18 is mounted to or positioned within the intermediate vessel 16 at a location that is spaced apart from the central axis $\mathbf{14}_{CA}$ of the outer vessel 14. In the illustrated embodiment, the distance between the central axis $\mathbf{18}_{CA}$ of the inner vessel 18 and the central axis $\mathbf{14}_{CA}$ of the outer vessel 14 is identified by the letter D. Preferably, the inner vessel 18 is mounted such that its central axis $\mathbf{18}_{CA}$ is co-linear with the central axis $\mathbf{16}_{CA}$ of the intermediate vessel 16. If the inner vessel 18 is not located on the central axis of the intermediate vessel 16, then the inner vessel 18 should be located so that a spacing always remains between the central axis $\mathbf{14}_{CA}$ of the outer vessel 14 and the central axis $\mathbf{18}_{CA}$ of the inner vessel 18.

The present invention induces high centrifugal and rotational forces on an object placed within the inner vessel. In order to accommodate the high loading attendant to the present invention, the vessels should preferably be made from high strength material, such as steel. The frame 12 and transmission drive (i.e., motor 20, drive shaft 22 and transmission 24) must also be designed to accommodate the anticipated high loads. Those skilled in the art would be readily capable for selecting the appropriate materials to support the anticipated speeds and loads associated with the present invention.

The high centrifugal and rotational force generated on an object using the present invention can be used for fast and precise finishing, producing a superior product with enhanced properties. Various objects can be finished using the present invention including, but are not limited to, any of those products identified in U.S. Pats. Nos. 5,355,638 and 5,848,929.

The high speeds produced by the present invention impose significant forces on objects contained within the inner vessel 18. It is anticipated that loads as high as 300 g's can be attained using the present invention. These loads are sufficiently high to cause intermixing of unlike materials. As such, the present invention can be used to process certain materials that were heretofore not combinable except under dangerous material processing operations, such as explosion welding.

Another embodiment of the high speed centrifugal device is shown in FIGS. 9 and 10. In this embodiment, two intermediate vessels 60 are mounted to a common drive shaft 26 but are located within two separate, vertically oriented outer vessels 14. The drive shaft 26 is attached to one or more drive arms 82 which, in turn, are driven by a transmission assembly 24 (and powered by a motor, not shown). The transmission rotates the drive arm 82 about a drive axis 85.

A counterweight 84 is mounted to the opposite end of the drive arm 82 from where the drive arm attaches to the drive shaft 26. The counterweight 84 is designed to balance out the eccentric loads caused by driving the intermediate and inner vessels. The counterweight is preferably adjustable/replaceable so that the proper weights can be attached to accommodate the products being finished.

Bearings 86 are preferably located between the drive shaft 26 and the drive arm 82 in order to permit the drive shaft 26 to rotate within the drive arm 82 as the intermediate vessel 60 is driven around the outer vessel 14.

The present invention may be embodied in other specific forms without departing from the spirit or essential attributes thereof and, accordingly, reference should be made to the appended claims, rather than to the foregoing specification, as indicating the scope of the invention.

What is claimed is:

1. An apparatus for performing high speed processing of a workpiece comprising:

a fixed, non-rotatable outer vessel having an inner cylindrical surface and a central axis;

at least one intermediate vessel located within the outer vessel, the intermediate vessel having an inner surface and an outer surface which contacts the inner surface of the outer vessel;

at least one inner vessel fixedly attached to and positioned within the intermediate vessel and adapted to receive an object to be subjected to a manufacturing process, the inner vessel having an outer surface and a central axis, the inner vessel being located at a position within the intermediate vessel such that the central axis of the inner vessel is spaced apart from the central axis of the outer vessel and the outer surface of the inner vessel is spaced apart from the inner surface of the intermediate vessel; and a drive system for rolling the intermediate vessel along the inner surface of the outer vessel, the rolling of the intermediate vessel causing the inner vessel to rotate about its axis and the axis of the outer vessel.

2. An apparatus for performing high speed processing according to claim 1 wherein there are a plurality of inner vessels mounted within the intermediate vessel.

3. An apparatus for performing high speed processing according to claim 1 wherein there are a plurality of intermediate vessels, each intermediate vessel having a corresponding inner vessel mounted therein.

4. An apparatus for performing high speed processing according to claim 1 wherein the inner vessel is mounted to the intermediate vessel such that the inner vessel rotates in conjunction with the intermediate vessel about the central axis of the outer vessel.

5. An apparatus for performing high speed processing of a workpiece comprising:

a fixed, non-rotatable outer vessel having an inner cylindrical surface and a central axis;

at least one intermediate vessel located within the outer vessel, the intermediate vessel having an outer surface which contacts the inner surface of the outer vessel;

at least one inner vessel positioned within the intermediate vessel and adapted to receive an object to be subjected to a manufacturing process, the inner vessel having a central axis, the inner vessel being located at a position within the intermediate vessel such that the central axis of the inner vessel is spaced apart from the central axis of the outer vessel; and a drive system for rolling the intermediate vessel along the inner surface of the outer vessel, the rolling of the intermediate vessel causing the inner vessel to rotate about its axis and the axis of the outer vessel;

wherein the outer vessel is mounted such that its central axis lies substantially along a horizontal plane, and wherein the drive system includes a motor;

a transmission engaged with the motor;

an output shaft driven by the transmission;

a drive arm fixedly attached to the output shaft;

a drive shaft connected to one end of the drive arm and attached to the intermediate vessel; and a counterweight attached to the other end of the drive arm, the counterweight balancing the load developed by the intermediate vessel and inner vessel during operation of the apparatus.

6. An apparatus for performing high speed processing according to claim 5 wherein the drive shaft is connected to the drive arm through a bearing which permits rotation of the drive shaft within the drive arm.

7. An apparatus for performing high speed processing according to claim 5 wherein there are two outer vessels mounted on opposite sides of a base, each outer vessel having an intermediate vessel and inner vessel disposed therein.

8. An apparatus for performing high speed processing according to claim 7 wherein the intermediate vessels are mounted on a common drive shaft.

9. An apparatus for performing high speed processing of a workpiece comprising:

an outer vessel having an inner surface and a central axis;

at least one intermediate vessel located within the outer vessel, the intermediate vessel having an inner surface and an outer surface which contacts the inner surface of the outer vessel;

at least one inner vessel fixedly attached to and positioned within the intermediate vessel and adapted to receive an object to be subjected to a manufacturing process, the inner vessel having an outer surface and a central axis, the inner vessel being located at a position within the intermediate vessel such that the central axis of the inner vessel is spaced apart from the central axis of the outer vessel and the outer surface of the inner vessel is spaced apart from the inner surface of the intermediate vessel; and a drive system for causing the intermediate vessel to roll along the inner surface of the outer vessel, the rolling of the intermediate vessel causing the inner vessel to rotate about its axis and the axis of the outer vessel.

10. An apparatus for performing high speed processing according to claim 9 wherein the inner vessel is removably mounted to the intermediate vessel.

11. An apparatus for performing high speed processing according to claim 9 wherein there are a plurality of inner vessels mounted within the intermediate vessel.

12. An apparatus for performing high speed processing according to claim 9 wherein there are a plurality of intermediate vessels, each intermediate vessel having a corresponding inner vessel mounted therein.

13. An apparatus for performing high speed processing according to claim 9 wherein the inner vessel is mounted to the intermediate vessel such that the inner vessel rotates in conjunction with the intermediate vessel about the central axis of the outer vessel.

14. An apparatus for performing high speed processing of a workpiece comprising:

an outer vessel having an inner surface and a central axis;

at least one intermediate vessel located within the outer vessel, the intermediate vessel having an outer surface which contacts the inner surface of the outer vessel;

at least one inner vessel positioned within the intermediate vessel and adapted to receive an object to be subjected to a manufacturing process, the inner vessel having a central axis, the inner vessel being located at a position within the intermediate vessel such that the central axis of the inner vessel is spaced apart from the central axis of the outer vessel; and a drive system for causing the intermediate vessel to roll along the inner surface of the outer vessel, the rolling of the intermediate vessel causing the inner vessel to rotate about its axis and the axis of the outer vessel;

wherein the outer vessel is mounted such that its central axis lies substantially along a horizontal plane, and wherein the drive system includes a motor;

a transmission engaged with the motor;

an output shaft driven by the transmission;

a drive arm fixedly attached to the output shaft;

a drive shaft connected to one end of the drive arm and attached to the intermediate vessel; and a counterweight attached to the other end of the drive arm, the counterweight balancing the load developed by the intermediate vessel and inner vessel during operation of the apparatus.

15. An apparatus for performing high speed processing according to claim 14 wherein the drive shaft is connected to the drive arm through a bearing which permits rotation of the drive shaft within the drive arm.

16. An apparatus for performing high speed processing according to claim 14 wherein there are two outer vessels mounted on opposite sides of a base, each outer vessel having an intermediate vessel and inner vessel disposed therein.

17. An apparatus for performing high speed processing according to claim 16 wherein the intermediate vessels are mounted on a common drive shaft.

18. An apparatus for performing high speed processing according to claim 9 wherein the outer vessel is cylindrical.

19. An apparatus for performing high speed processing according to claim 9 wherein the intermediate vessel is cylindrical.

20. An apparatus for performing high speed processing according to claim 9 wherein the outer vessel and intermediate vessel are cylindrical.

21. An apparatus for performing high speed processing of a workpiece comprising:

a fixed, non-rotatable outer vessel having an inner cylindrical surface and a central axis;

at least one intermediate vessel located within the outer vessel, the intermediate vessel having an outer surface which contacts the inner surface of the outer vessel;

an processing container adapted to receive an object to be subjected to a manufacturing process, the processing container being defined by an inner wall, the inner wall being fixedly attached to the intermediate vessel and located at a position within the intermediate vessel that is spaced from the outer surface of the intermediate vessel, the fixed location being at a position such that the inner wall of the processing container is spaced apart from the central axis of the outer vessel; and a drive system for rolling the intermediate vessel along the inner surface of the outer vessel, the rolling of the intermediate vessel causing the processing container to rotate about its axis and the axis of the outer vessel.

22. An apparatus for performing high speed processing of a workpiece comprising:

an outer vessel having an inner surface and a central axis;

at least one intermediate vessel located within the outer vessel, the intermediate vessel having an outer surface which contacts the inner surface of the outer vessel;

at least one processing container defined by an inner wall, the inner wall located at a positioned within the intermediate vessel that is spaced apart from the outer surface of the intermediate vessel and adapted to receive an object to be subjected to a manufacturing process, the processing container having a central axis, the processing container being located at a position within the intermediate vessel such that the central axis of the processing container is spaced apart from the central axis of the outer vessel; and a drive system for causing the intermediate vessel to roll along the inner surface of the outer vessel, the rolling of the intermediate vessel causing the inner vessel to rotate about its axis and the axis of the outer vessel wherein the outer vessel is mounted such that its central axis lies substantially along a horizontal plane, and wherein the drive system includes a motor;

a transmission engaged with the motor;

an output shaft driven by the transmission;

a drive arm fixedly attached to the output shaft;

a drive shaft connected to one end of the drive arm and attached to the intermediate vessel; and a counterweight attached to the other end of the drive arm, the counterweight balancing the load developed by the intermediate vessel and processing container during operation of the apparatus.

23. An apparatus for performing high speed processing according to claim 1 wherein inner surface of the intermediate vessel is non-cylindrical.

24. An apparatus for performing high speed processing according to claim 1 wherein inner surface of the inner vessel is non-cylindrical.

* * * * *